US006531269B2

(12) United States Patent
Wirowski et al.

(10) Patent No.: US 6,531,269 B2
(45) Date of Patent: Mar. 11, 2003

(54) COLOR PHOTOGRAPHIC SILVER HALIDE MATERIAL

(75) Inventors: Ralf Wirowski, Köln (DE); Jan Haller, Leverkusen (DE); Stefan Herrmann, Langenfeld (DE); Jürgen Jung, Leverkusen (DE)

(73) Assignee: Agfa-Gevaert N.V. (BE)

( * ) Notice: Subject to any disclaimer, the term of this patent is extended or adjusted under 35 U.S.C. 154(b) by 0 days.

(21) Appl. No.: 09/804,564

(22) Filed: Mar. 12, 2001

(65) Prior Publication Data

US 2001/0036603 A1 Nov. 1, 2001

(30) Foreign Application Priority Data

Mar. 17, 2000 (DE) ..... 100 13 135

(51) Int. Cl.[7] ..... G03C 7/333; G03C 7/305

(52) U.S. Cl. ..... 430/362; 430/505; 430/552; 430/553; 430/555; 430/557; 430/558

(58) Field of Search ..... 430/505, 555, 430/557, 558, 552, 553, 362

(56) References Cited

U.S. PATENT DOCUMENTS 5,037,728 A * 8/1991 Shiba et al. ..... 430/505
5,108,883 A * 4/1992 Matejec et al. ..... 430/504
5,441,856 A * 8/1995 Merkel et al. ..... 430/504
5,460,930 A * 10/1995 Merkel et al. ..... 430/504
5,466,566 A * 11/1995 Tashiro et al. ..... 430/505
5,510,235 A * 4/1996 Merkel et al. ..... 430/553
6,132,943 A * 10/2000 Younathan et al. ..... 430/504

* cited by examiner

*Primary Examiner*—Janet Baxter
*Assistant Examiner*—Amanda C. Walke
(74) *Attorney, Agent, or Firm*—Connolly Bove Lodge & Hutz LLP

(57) ABSTRACT

A color photographic silver halide material, which has a support which comprises at least one blue-sensitive, yellow-coupling silver halide emulsion layer nearest the light source and at least one green-sensitive, magenta-coupling silver halide emulsion layer and at least one red-sensitive, cyan-coupling silver halide emulsion layer which are further from the light source than is the at least one blue-sensitive layer, and which contains at least one cyan masking coupler which has its maximum absorption above 650 mn, the red-sensitive layers have their maximum sensitivity at 620±20 nm and the absorption of the masking coupler at the maximum sensitivity of the red-sensitive layers is at most 70% of its absorption at 690 mn, is distinguished by improved color reproduction and color saturation in the magenta layer without loss of sensitivity.

20 Claims, No Drawings

COLOR PHOTOGRAPHIC SILVER HALIDE MATERIAL

This invention relates to a colour photographic silver halide material which has a support and at least one light-sensitive silver halide emulsion layer, and which contains a new type of masking coupler.

In colour photographic negative films, the colour saturation and colour reproduction are adjusted to the desired values by the interaction between DIR couplers and masking couplers in the individual layers.

A typical colour negative film contains at least one blue-sensitive, yellow-coupling silver halide emulsion layer next to the light source, and contains at least one green-sensitive, magenta-coupling silver halide emulsion layer and at least one red-sensitive, cyan-coupling silver halide emulsion layer which are further from the light source than is the at least one blue-sensitive layer.

Due to this arrangement, the only masking couplers which are known are those which couple from yellow to magenta and which are situated in a green-sensitive layer, and those which couple from yellow to cyan or from magenta to cyan and which are situated in a red-sensitive layer.

Cyan masking couplers, irrespective of the colour to which they couple, are not used for light-sensitive layers disposed underneath them, due to the filter effect and losses of sensitivity which are associated with them.

Surprisingly, it has now been found that even masking couplers which exhibit a coupling effect to cyan, magenta, yellow, red or to colourless substances can be used without losses of sensitivity if certain conditions of compatibility are complied with.

Thus, compared with the use of DIR couplers, colour reproduction and colour saturation can also be improved in the yellow and/or magenta layers without loss of sensitivity.

The present invention therefore relates to a colour photographic silver halide recording material of the type cited at the outset, which contains at least one cyan masking coupler which has its maximum absorption above 650 mn, wherein the red-sensitive layers have their maximum sensitivity at 620±20 mn and wherein the absorption of the masking coupler at the maximum sensitivity of the red-sensitive layers is at most 70% of its absorption at 690 nm.

The maximum absorption of the cyan masking coupler preferably corresponds to the spectral sensitivity to red of a readout sensor which has a functional relationship to the silver halide recording material, wherein a colour photographic paper or a scanner can function as a readout sensor, for example.

In the sense of the present invention, the expression "functional relationship" means that an image recorded by the material according to the invention is read out by the readout sensor, for example by an analogous exposure through the colour negative which is obtained from the material according to the invention on to the colour paper which is the readout sensor, or by reading the image information of the colour negative by means of a semiconductor sensor, e.g. by means of a CCD as a readout sensor.

In particular, the masking coupler corresponds to formula (I)

Kup-Link-Farb (I)

wherein

Kup denotes the residue of a colour coupler,

Link denotes a linking group, and

Farb denotes the residue of a cyan dye.

Under conditions of chromogenic processing, the colour couplers can give rise in particular to colourless, magenta, yellow or red compounds, or to compounds which can be washed out in the processing method used.

For magenta-coupling masking couplers, Kup-Link preferably corresponds to formulae (II) and (III):

(II)

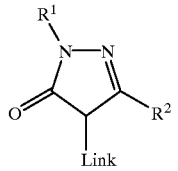

(III)

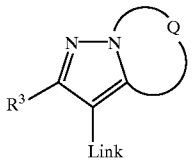

wherein $R^1$ denotes an unsubstituted phenyl or a phenyl which is singly- or multiply-substituted by a halogen, alkyl, cyano, alkoxy, alkoxycarbonyl or acylamino, $R^2$ denotes alkylamino, arylamino, acylamino or carbamoylamino, $R^3$ denotes a hydrogen atom or a substituent, and Q denotes the non-metallic atoms for the completion of a 5-membered azole ring which contains 2 to 4 nitrogen atoms and which can be substituted.

$R^1$ preferably denotes a phenyl group which is substituted by one or more halogen atoms, particularly 2,4,6-trichlorophenyl, 2,5-dichlorophenyl or 2-chlorophenyl, and $R^2$ preferably denotes arylamino or acylamino.

In particular, the couplers of formula (III) comprise pyrazolo[1,5-b]-[1,2,4]triazoles or pyrazolo[5,1-c]-[1,2,4] triazoles.

For yellow-coupling masking couplers, Kup-Link preferably corresponds to formula (IV):

(IV)

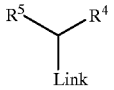

wherein $R^4$ and $R^5$ independently denote electron acceptor groups, such as acyl, alkoxycarbonyl, aryloxycarbonyl, carbamoyl, cyano, nitro, sulphamoyl, alkylsulphonyl, arylsulphonyl, aryl, or heterocyclic groups which can be joined to form a ring, $R^4$ preferably denotes $CONHR^{41}$, wherein $R^{41}$ constitutes a substituted phenyl, and $R^5$ preferably denotes $COR^{51}$ , wherein $R^{51}$ constitutes tert.-butyl, 4-methoxyphenyl or 1-ethylcyclopropyl.

At least one of the $R^1$ and $R^2$ radicals in formula (II), or the $R^3$ radical in formula (III), or one of the $R^4$ and $R^5$ radicals in formula (IV), preferably contains a ballast group which renders the masking coupler emulsifiable in a coupler solvent and which keeps the dye which is formed during colour development sufficiently hydrophobic so that it remains in the coupler solvent.

If none of the aforementioned radicals contains a ballast group, but instead contains a group which imparts solubility in water, then the dye formed during development is water-soluble and is washed out, and the masking coupler acts as a colourless-coupling masking coupler.

Suitable Kup coupler residues are listed below, where the coupling site, which at the same time is the bonding site to Link, is denoted by "Link".

Link can be a single chemical bond or a bridging member which is bonded to the coupling position of Kup via a sulphur, nitrogen or oxygen atom. Link can contain one or more time control groups, which means that after the cleavage of the bond between Kup and Link in the course of chromogenic development the Link-Farb radical decomposes into one or more fragments after a chronological delay. If Kup does not contain a ballast radical, Link should contain a ballast radical in order to make the masking coupler resistant to diffusion.

Examples of Link groups are listed below. Kup and Farb are also given, in order to unambiguously determine the position of Link.

Farb is a chromophore, the extinction coefficient of which at 690 nm is preferably at least 30% higher than it is at 620 nm. In particular, Farb is an azomethine dye comprising one of the coupler residues of formulae (V) to (X), which are customary in photography, and a phenylenediamine developer component of formula (XI)

(V)

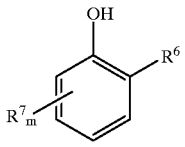

(VI)

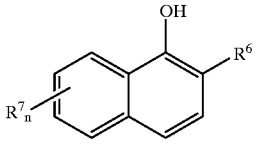

(VII)

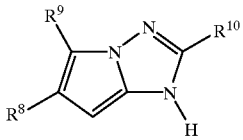

(VIII)

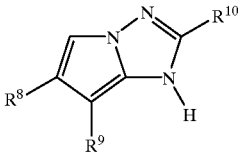

(IX)

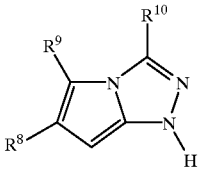

-continued (X)

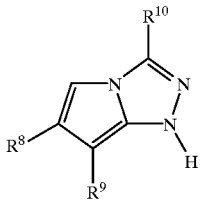

wherein $R^6$ denotes H, $SO_2NR^{61}R^{62}$, $SO_3R^{61}$, $CO_2R^{61}$, $CONR^{61}R^{62}$, $NHCOR^{62}$, $NHCONR^{61}R^{62}$, $NHSO_2NR^{61}R^{62}$, $NHSO_2R^{61}$, or hetaryl, $R^7$ denotes a substituent, $R^8$, $R^9$, $R^{10}$, $R^{61}$, $R^{62}$, independently of each other, denote H or a substituent, wherein $R^8$ and $R^9$ or $R^{61}$ and $R^{62}$ can be linked to form a ring, m denotes 0–2, n denotes 0–4, (XI)

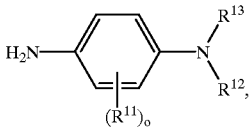

wherein $R^{11}$ denotes a substituent, particularly alkyl, alkoxy or acylamino, $R^{12}$, $R^{13}$ denote alkyl, aryl or hetaryl, or $R^{11}$ and $R^{12}$ together or $R^{12}$ and $R^{13}$ together denote the remaining members of a ring, particularly of a 5- or 6-membered ring, o denotes a number from 0 to 4, and Farb is linked to Link by one of the substituents $R^6$ to $R^{13}$ and one of the $R^6$ to $R^{13}$ radicals, or the Link radical, provided that it remains linked to Farb after chromogenic processing, contains at least one group which imparts water-solubility, for example a sulphonic acid, a sulphonamide, a carboxylic acid, a carbonamide, a hydroxy group, a polyether, an amino group or an acid group which contains phosphorus, in order to wash out the Farb or Farb-Link fragment.

Sulphonic acid and carboxylic acid groups are preferred. $R^6$ to $R^{13}$ are not ballasted.

Examples of Farb are listed below.

Examples of Kup-Link

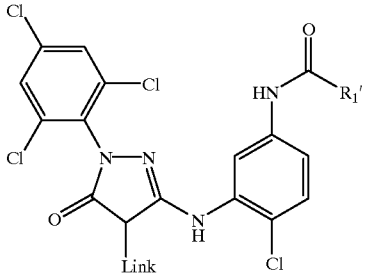

-continued
Kup1: $R_1'$ =
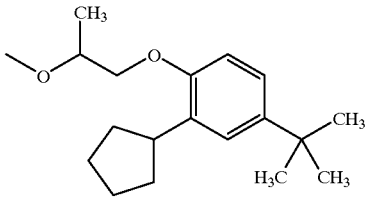
Kup2: $R_1'$ =
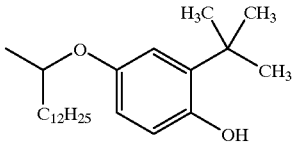
Kup3: $R_1'$ = $C_{13}H_{27}$
Kup4: $R_1'$ =
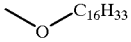
Kup5: $R_1'$ =
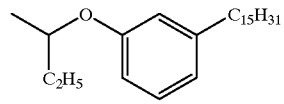
Kup6:
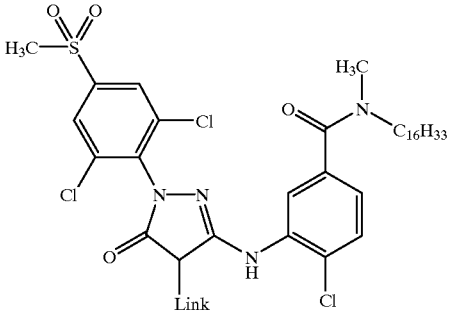
Kup7:
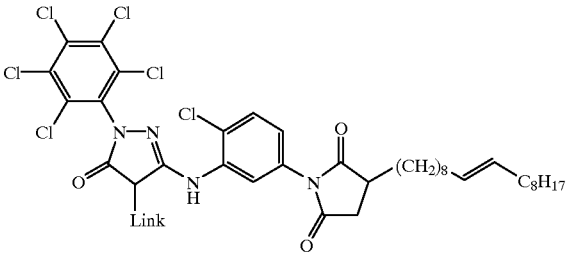
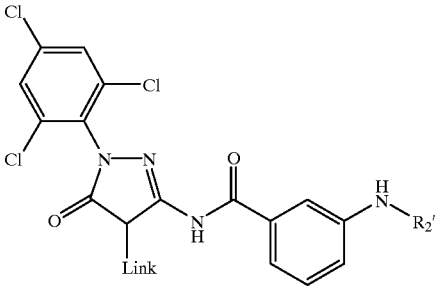
Kup8: $R_2'$ =
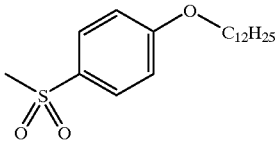
-continued
Kup9: $R_2'$ =
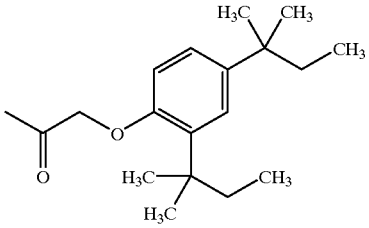
Kup10: $R_2'$ =
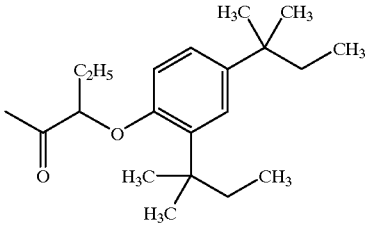
Kup11:
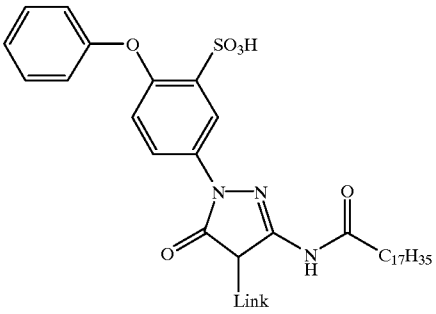
Kup12:
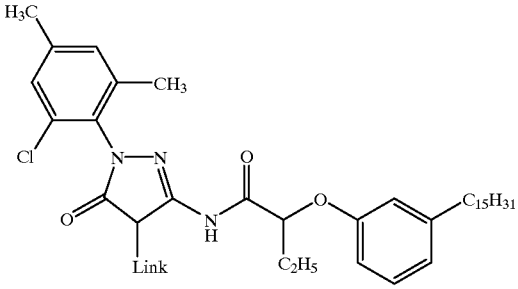
Kup13:
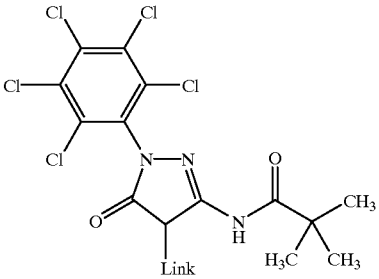
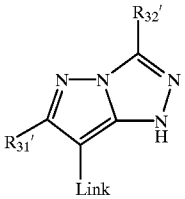
Kup14: $R_{31}'$ = $H_3C$ $CH_3$ $R_{32}'$ =
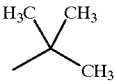
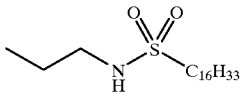

-continued

Kup15: $R_{31}'$ =

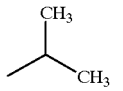

$R_{32}'$ =

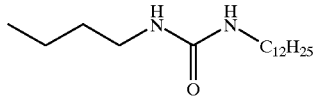

Kup16: $R_{31}'$ = $H_3C$ $CH_3$

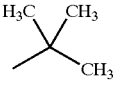

$R_{32}'$ =

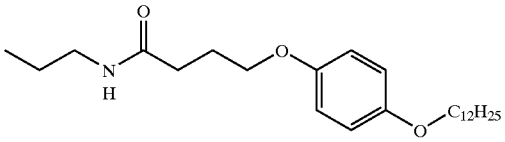

Kup17: $R_{31}'$ = $H_3C$ $CH_3$

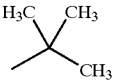

$R_{32}'$ =

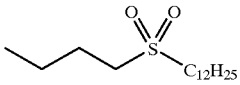

Kup18: $R_{31}'$ = $H_3C$ $CH_3$

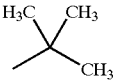

$R_{32}'$ =

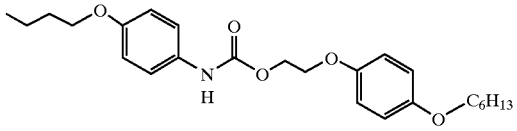

Kup19: $R_{31}'$ = $H_3C$ $CH_3$

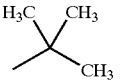

$R_{32}'$ =

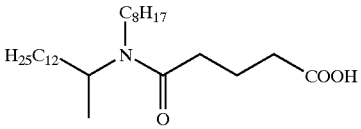

Kup20: $R_{31}'$ =

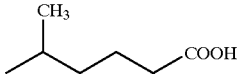

$R_{32}'$ =

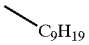

Kup21: $R_{31}'$ =

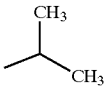

$R_{32}'$ =

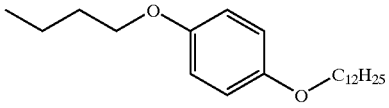

Kup22: $R_{31}'$ = $H_3C$ $CH_3$

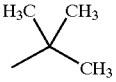

$R_{32}'$ =

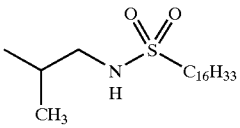

Kup23: $R_{31}'$ = $H_3C$ $CH_3$

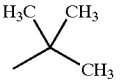

$R_{32}'$ = $H_{25}C_{12}$

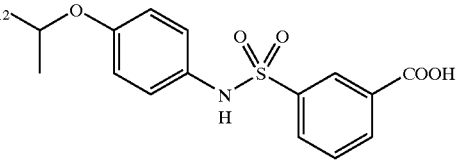

Kup24: $R_{31}'$ = $H_3C$ $CH_3$

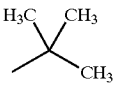

-continued $R_{32}'$ =

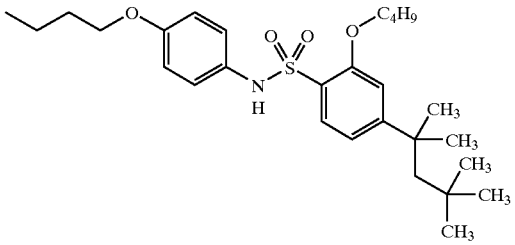

Kup25: $R_{31}'$ =

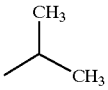

$R_{32}'$ =

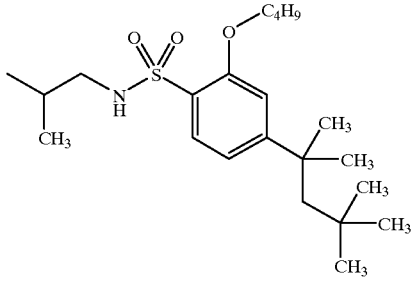

Kup26: $R_{31}'$ =

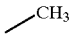

$R_{32}'$ =

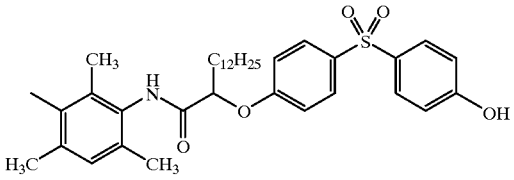

Kup27: $R_{31}'$ = $H_3C$ $CH_3$

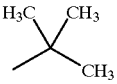

$R_{32}'$ =

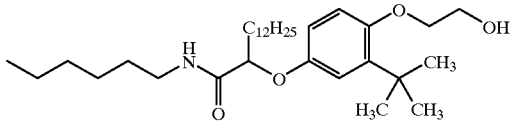

Kup28: $R_{31}'$ = $H_3C$ $CH_3$ $R_{32}'$ =

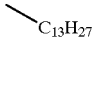

Kup29: $R_{31}'$ = $H_3C$ $CH_3$

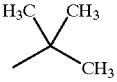

$R_{32}'$ =

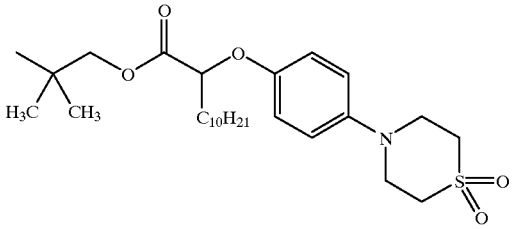

Kup30: $R_{31}'$ = $H_3C$ $CH_3$

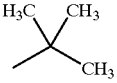

-continued
$R_{32}'$ =
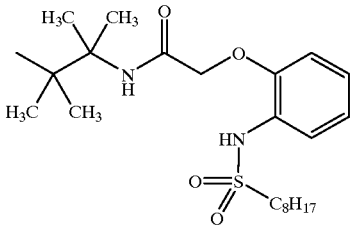
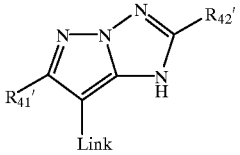
Kup31: $R_{41}'$ = $CH_3$
$R_{42}'$ =
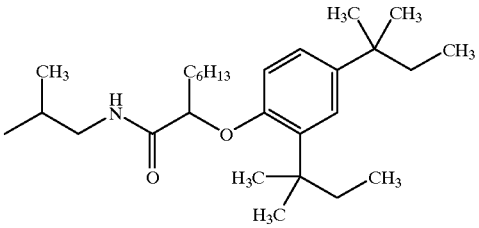
Kup32: $R_{41}'$ = $CH_3$
$R_{42}'$ =
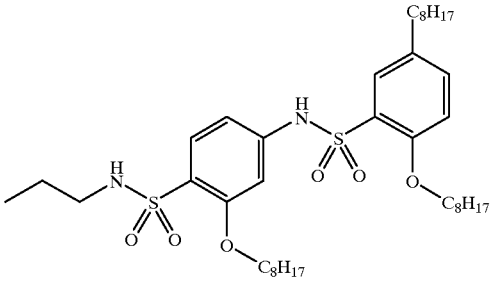
Kup33: $R_{41}'$ =
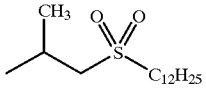
$R_{42}'$ =
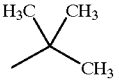
Kup34: $R_{41}'$ =
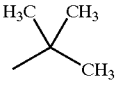
$R_{42}'$ =
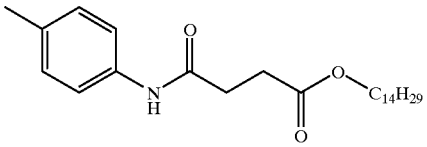
Kup35: $R_{41}'$ =
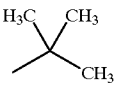
$R_{42}'$ =
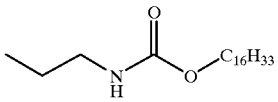
Kup36: $R_{41}'$ =
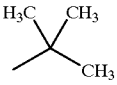
-continued
$R_{42}'$ =
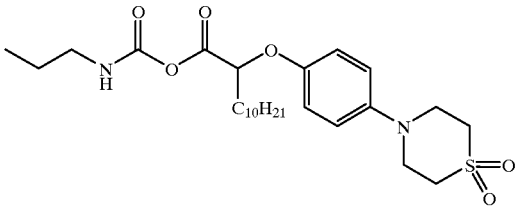
Kup37: $R_{41}'$ =
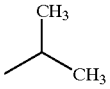
$R_{42}'$ =
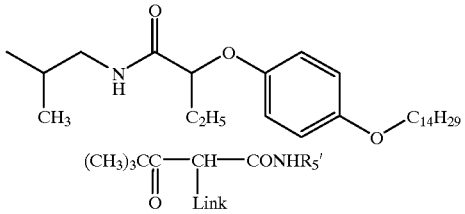
Kup38:
$R_5'$ = Cl
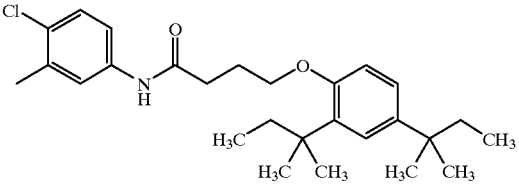
Kup39: $R_5'$ = Cl
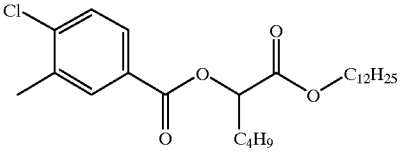
Kup40:
$R_5'$ =
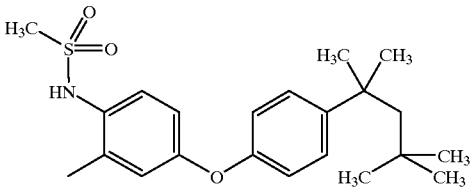
Kup41: $R_5'$ = Cl
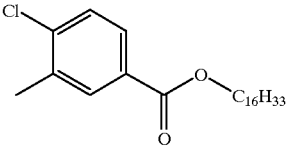
Kup42: $R_5'$ =
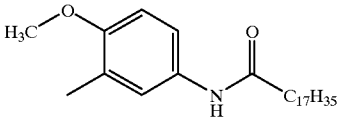
Kup43: $R_5'$ =
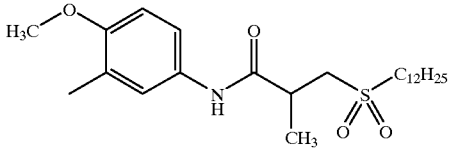
Kup44: $R_5'$ = Cl
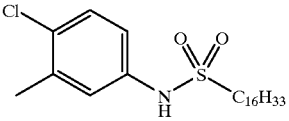

-continued
Kup45: $R_5' =$
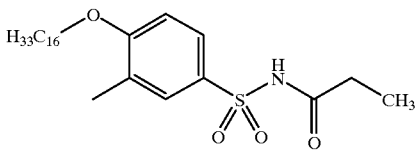
Kup46:
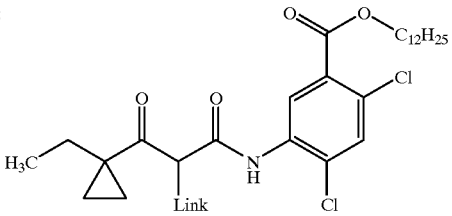
Kup47:
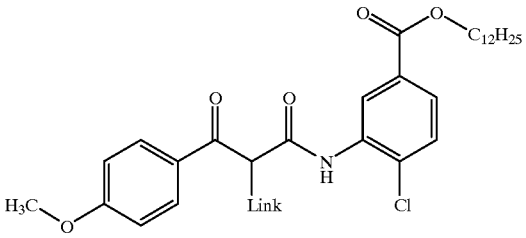
Kup48:
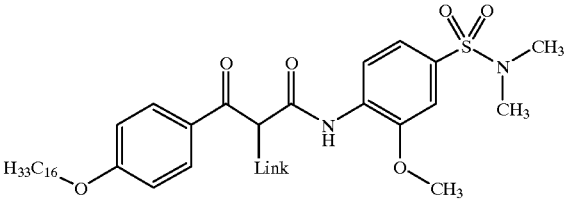
Kup49:
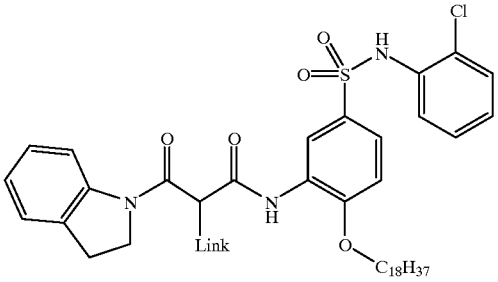
Kup50:
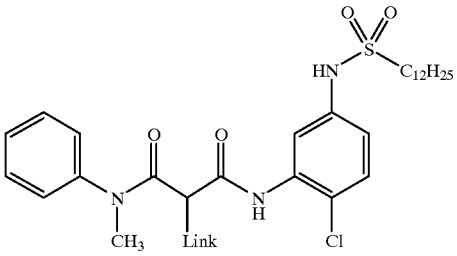
-continued
Kup51:
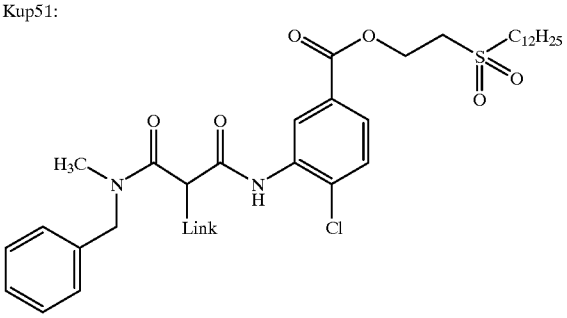
Kup52:
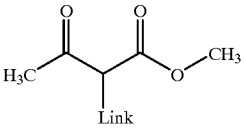
Kup53:
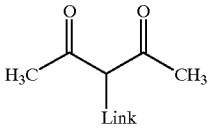
Kup54:
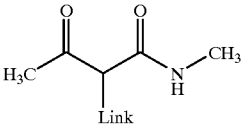
Kup55:
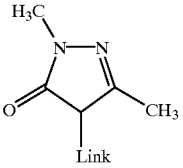
Kup56:
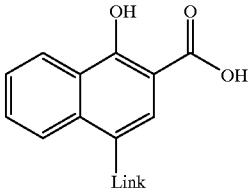
Kup57:
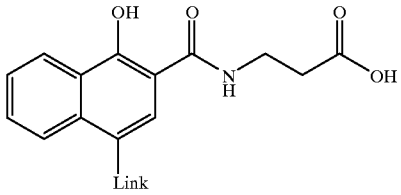
Kup58:
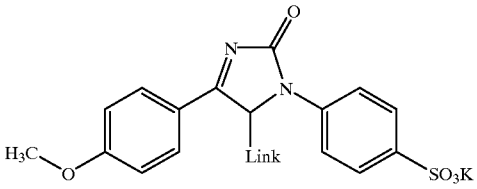
Examples of Link
Link1:
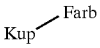

-continued
Link2:
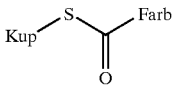
Link3:
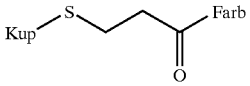
Link4:
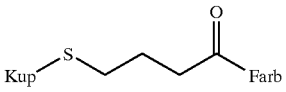
Link5:
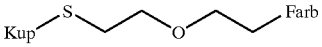
Link6:
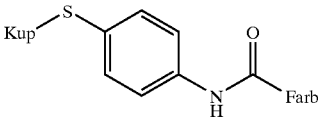
Link7:
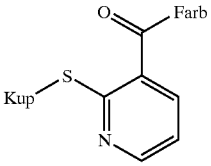
Link8:
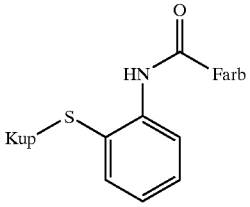
Link9:
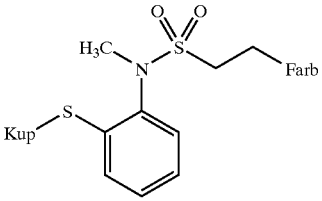
Link10:
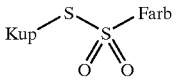
Link11:
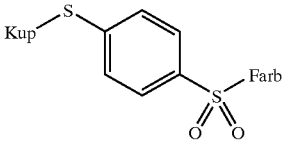
Link12:
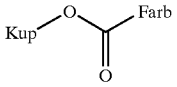
Link13:
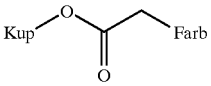
-continued
Link14:
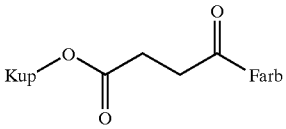
Link15:
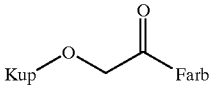
Link16:
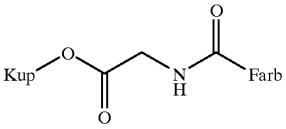
Link17:
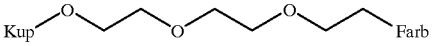
Link18:
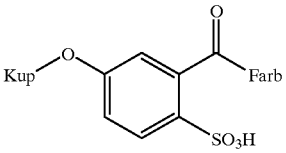
Link19:
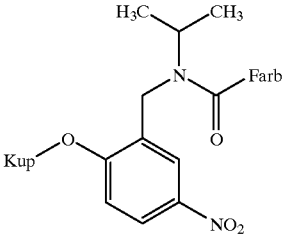
Link20:
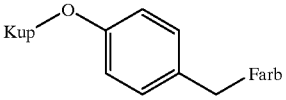
Link21:
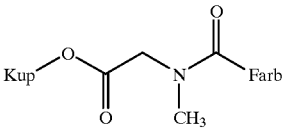
Link22:
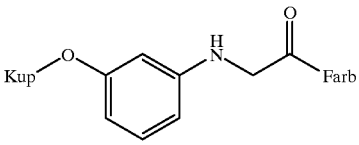
Link23:
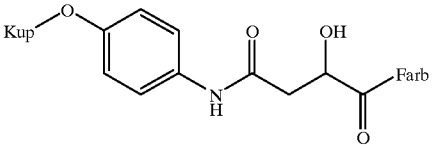

-continued
Link24:
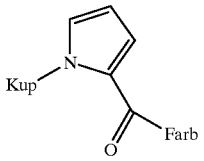
Link25:
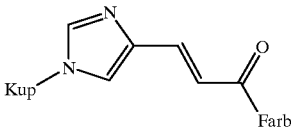
Link26:
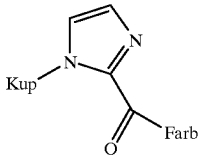
Link27:
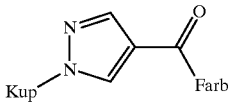
Link28:
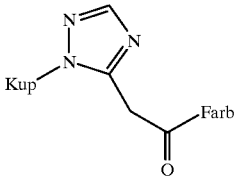
Link29:
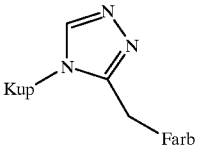
Link30:
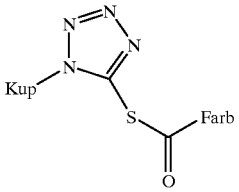
Link31:
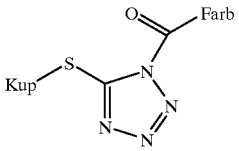
-continued
Link32:
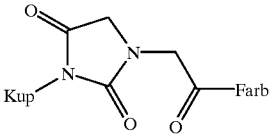
Link33:
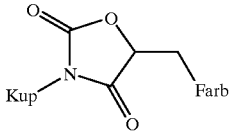
Link34:
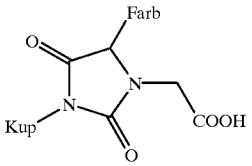
Link35:
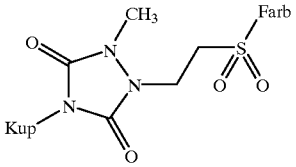
Link36:
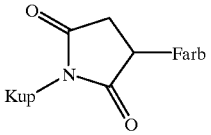
Link37:
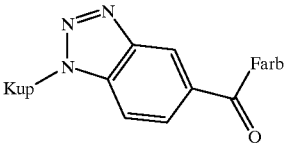
Link38:
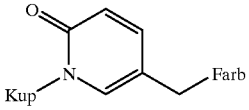
Link39:
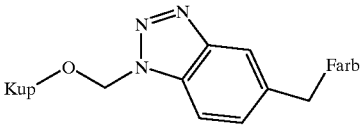

-continued
Link40:
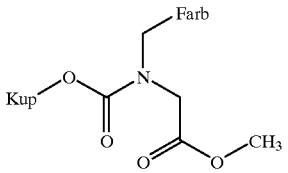
Link41:
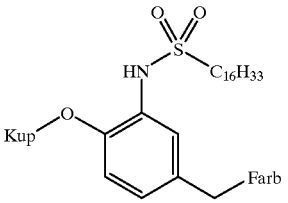
Link42:
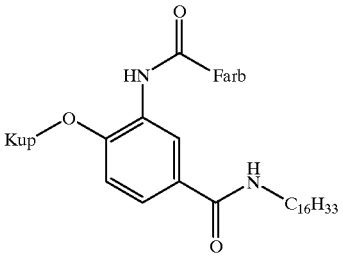
-continued
Link43:
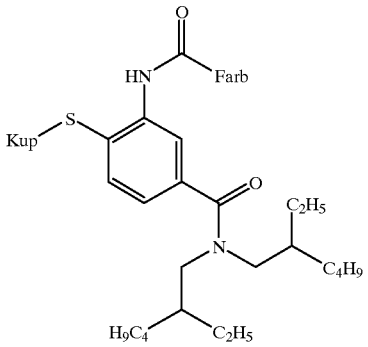
Link44:
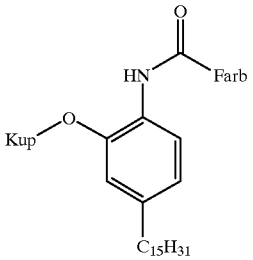
Examples of Farb
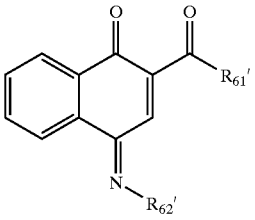
Farb1:
$R_{61}'$ =
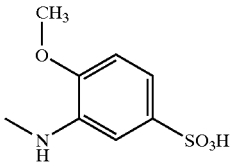
$R_{62}'$ =
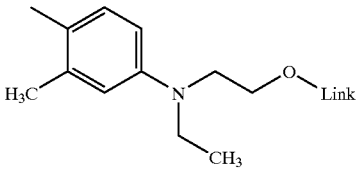
Farb2:
$R_{61}'$ =
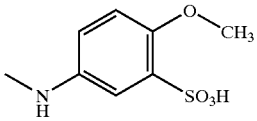
$R_{62}'$ =
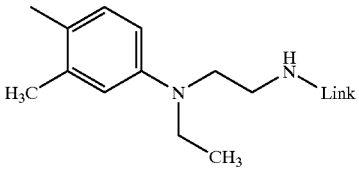
Farb3:
$R_{61}'$ =
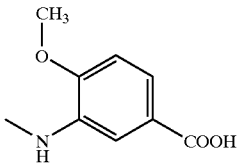
$R_{62}'$ =
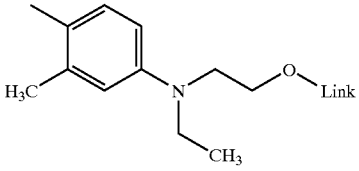

-continued
Farb4:
$R_{61}'$ =
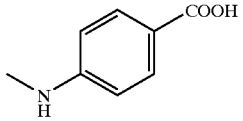
$R_{62}'$ =
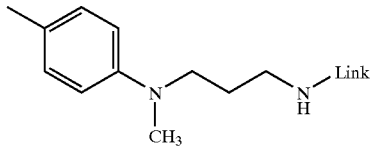
Farb5:
$R_{61}'$ =
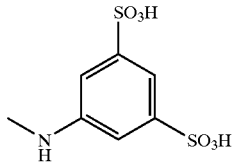
$R_{62}'$ =
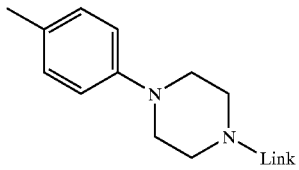
Farb6:
$R_{61}'$ =
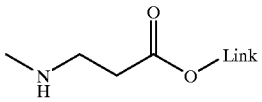
$R_{62}'$ =
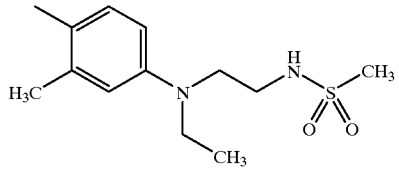
Farb7:
$R_{61}'$ =
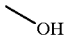
$R_{62}'$ =
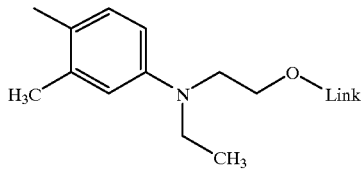
Farb8:
$R_{61}'$ =
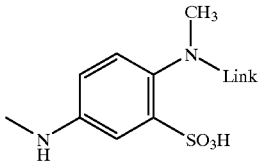
$R_{62}'$ =
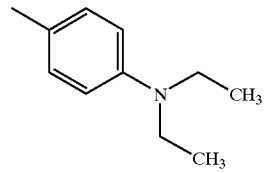
Farb9:
$R_{61}'$ =
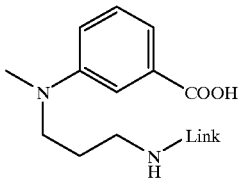
$R_{62}'$ =
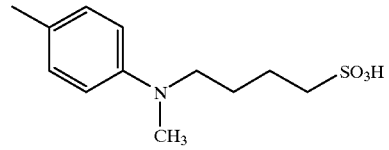
Farb10:
$R_{61}'$ =
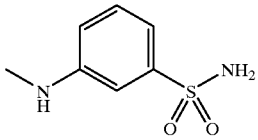
$R_{62}'$ =
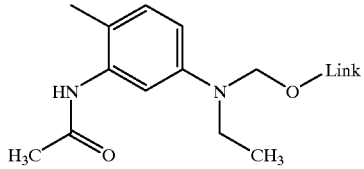

-continued
Farb11:
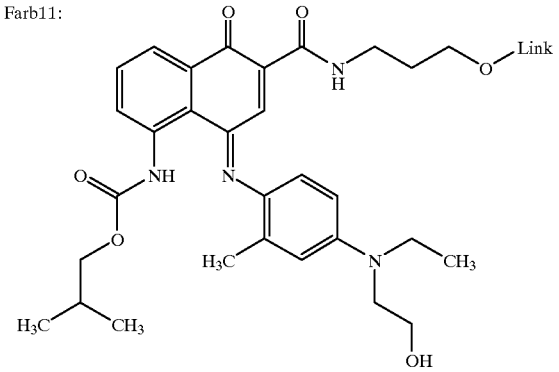
Farb12:
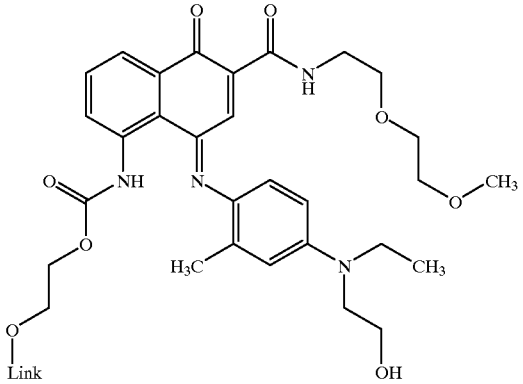
Farb13:
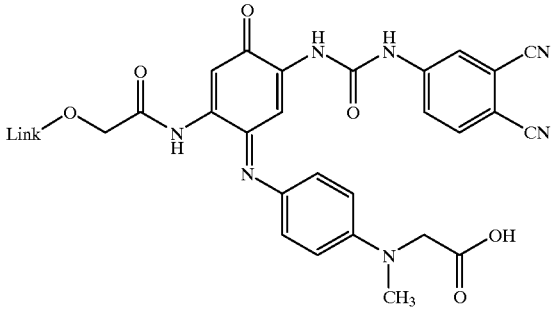
Farb14:
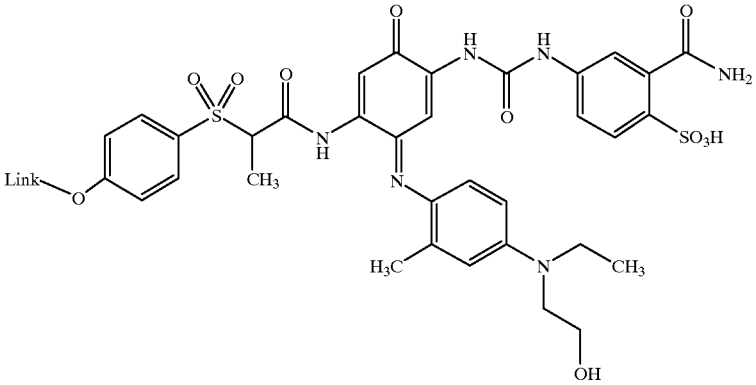
Farb15:
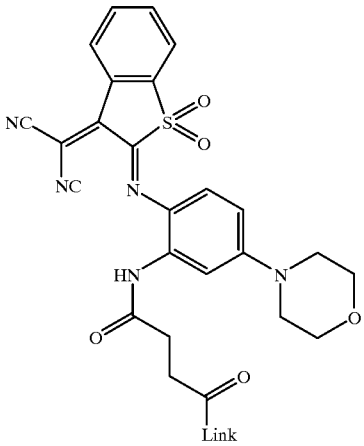
Farb16:
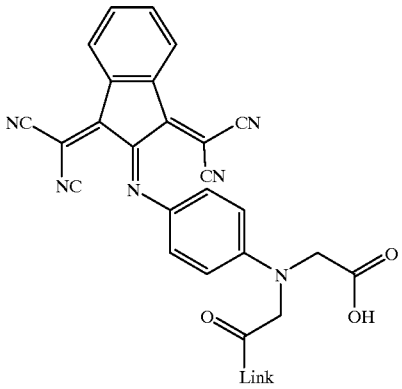

-continued
Farb17:
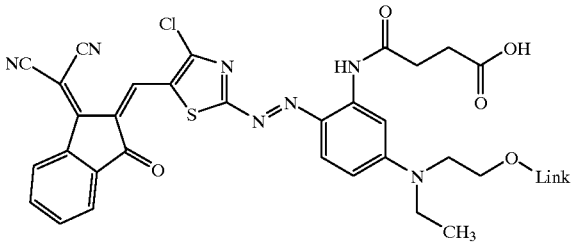
Farb18:
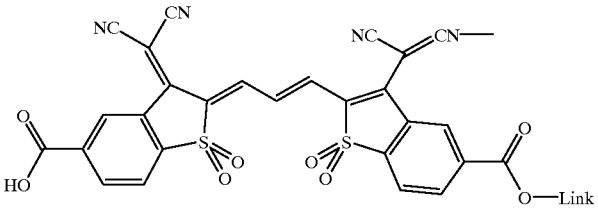
Farb19:
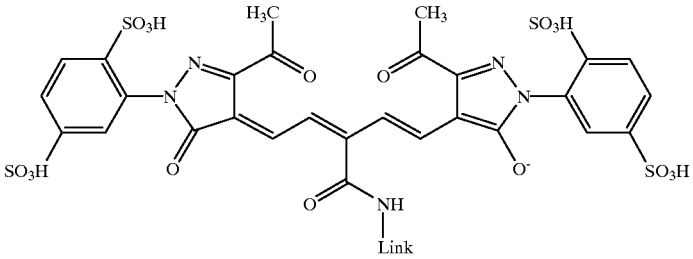
Farb20:
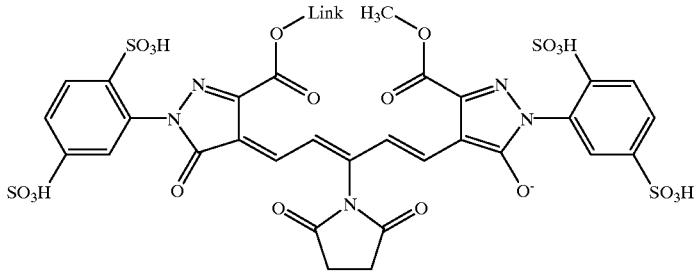
Farb21:
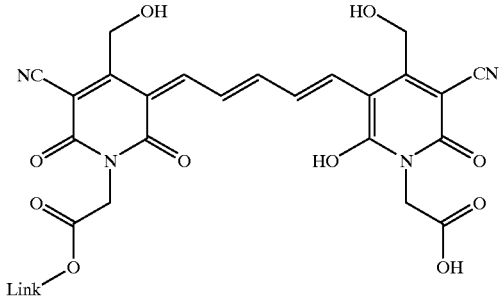
Farb22:
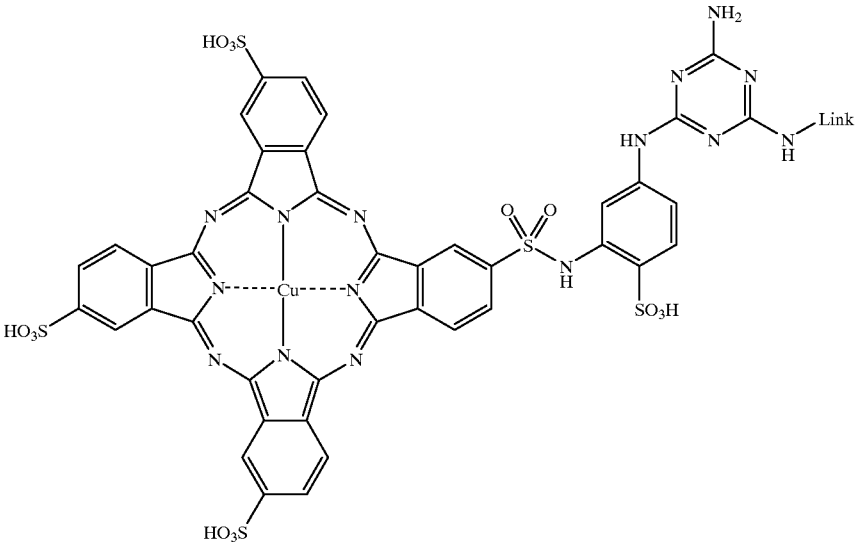

Other preferred embodiments of the invention are given in the subsidiary claims. In particular, all the blue-sensitive layers are disposed nearer the light source than are all the green- and red-sensitive layers, and all the green-sensitive layers are most preferably disposed nearer the light source than are all the red-sensitive layers.

Synthesis of compound MK1 (Kup3-Link8-Farb1):

Synthesis of compound 2:

263 g (2.1 mol) 2-aminothiophenol were dissolved in 1 l ethanol and were slowly mixed with 107 g (1.1 mol) of 35% hydrogen peroxide at room temperature, with cooling. Disulphide 2 precipitated in the course of this procedure. After stirring for 2 hours at room temperature, filtering off the product and washing it with ethanol, 185.3 g (71%) of a yellow solid were obtained.

Synthesis of compound 4:

75 g (122 mmol) magenta coupler 3 and 15.2 g (61 mmol) disulphide 2 were dissolved in 250 ml ethyl acetate and were treated successively with a solution of 17 g potassium carbonate in 45 ml water and with 50 ml dimethylacetamide. Air was passed through this mixture at 30–40° C. for 16 hours. The mixture was poured on to iced water and the product was extracted with ethyl acetate. The organic phase was washed three times with water and was thereafter treated with 13 g (130 mmol) conc. hydrochloric acid. After cooling the mixture, the solid was filtered off under suction, washed with ethyl acetate and dried. 73.8 g (82%) of the hydrochloride of 4 were obtained.

Synthesis of compound 5:

A solution of 15.5 g (20 mmol) amine 4 in 120 ml dimethylacetamide was treated first with 2.8 ml (20 mmol) triethylamine, and was then slowly treated at 15–20° C. with a solution of 4.2 g (20 mmol) of 97% chloroformic acid 4-nitrophenyl ester in 15 ml tetrahydrofuran. After stirring for 16 hours at room temperature, the product mixture was poured into iced water which had been acidified with conc. hydrochloric acid and the product was extracted with ethyl acetate. The organic phase was washed with dilute hydrochloric acid and was washed three times with water, and was dried over sodium sulphate. After removing the solvent, the residue was stirred for 1–2 hours with diisopropyl ether, and was filtered off and washed with diisopropyl ether. After drying, 14 g (78%) of 5 were obtained.

Synthesis of compound 8:

A solution of 79.2 g (0.3 mol) naphthol compounds (6) and 72 g (0.3 mol) amine 7 in 0.9 l dimethylformamide was heated for 6 hours under reflux. Thereafter, the solid was filtered off, the bulk of the solvent was removed under vacuum, and the residue was recrystallised from 150 ml isopropanol. 59.7 g (53%) of cyan coupler 8 were obtained.

Synthesis of compound 10:

A solution of 15 g (40 mmol) coupler 8 in 410 ml methanol was treated successively, at room temperature, with 48 ml of a 30% solution of sodium methylate and with a solution of 16.8 g (50 mmol) of colour developer CD4 ($9 \cdot 1.5H_2SO_4$) in 20 ml water, and was then slowly mixed with a solution of 22.6 g (100 mmol) ammonium persulphate in 166 ml water. After stirring for a further 30 minutes at room temperature, the solid was filtered off, washed with methanol, dried, stirred with water, filtered off again, washed with water and dried. 13.9 g (62%) of the solid dye 10 were obtained, a $10^{-4}$ molar solution of which in phenoxyethanol/methanol (3:7) exhibited an absorption maximum at 708 nm.

Synthesis of masking coupler MK1:

A solution of 1.9 g (3.3 mmol) 5, 3.0 g (3.3 mmol) 10 and 0.7 g (6.6 mmol) triethylamine in 15 ml dimethylformamide was heated at 90–100 ° C. for 20 minutes. After cooling to room temperature, the mixture was poured into iced water which had been acidified with hydrochloric acid. The solid was filtered off, washed with water, dried, boiled for 5 minutes with n-propanol, filtered off at room temperature, washed with n-propanol and dried. 1.0 g (23%) of masking coupler MK1 were obtained, a $10^{-4}$ molar solution of which in phenoxyethanol/methanol (3:7) exhibited an absorption maximum at 704 nm.

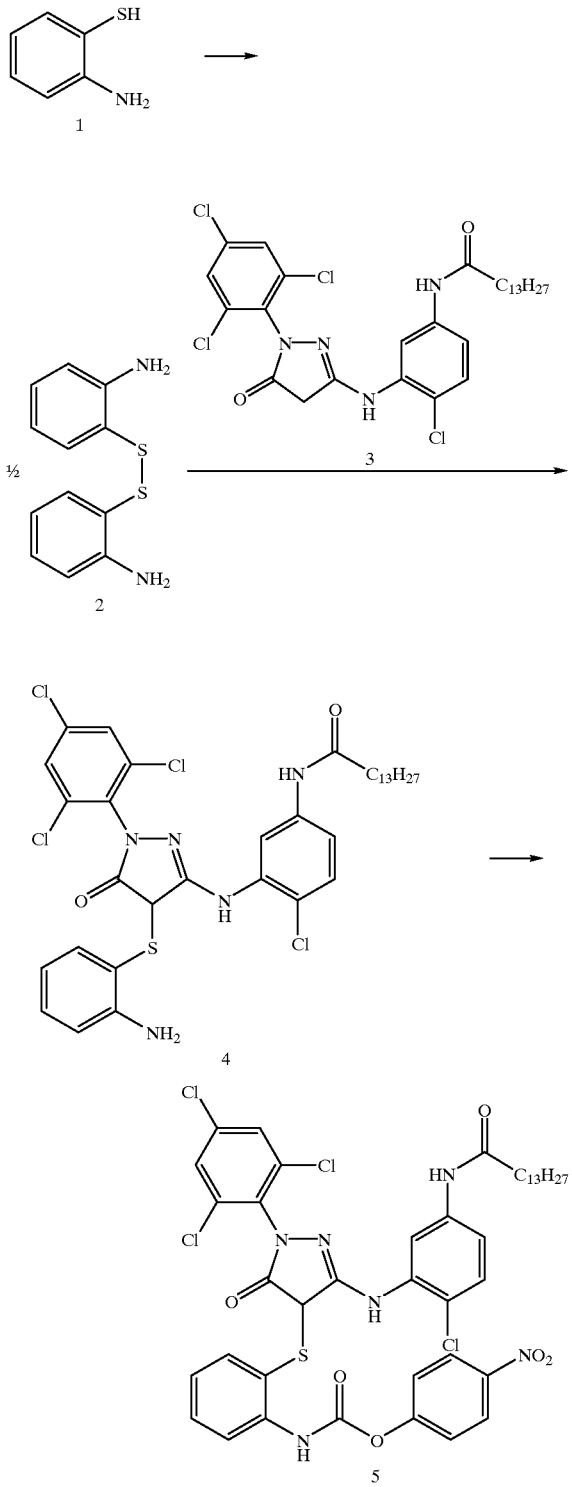

-continued

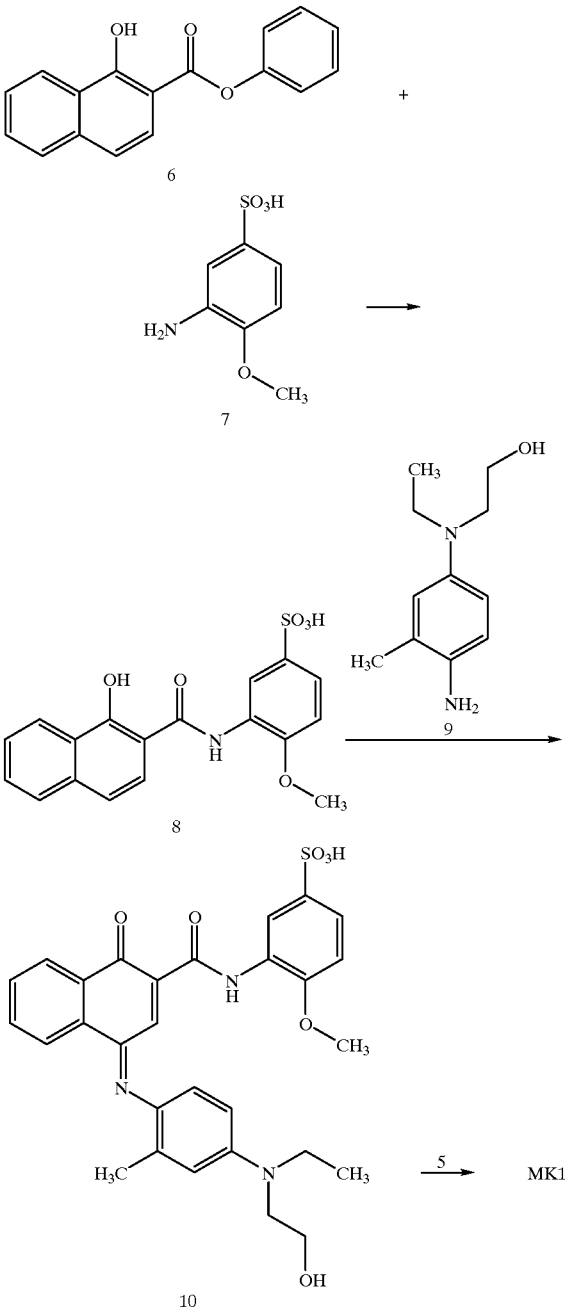

Examples of colour photographic materials include colour negative films, colour reversal films, colour positive films, colour photographic paper, colour reversal photographic paper, and colour-sensitive materials for the colour diffusion transfer process or the silver colour bleaching process. A review is given in Research Disclosure 37038 (1995) and in Research Disclosure 38957 (1996).

Photographic materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285 and in Research Disclosure 38957, Part XV (1996), page 627.

Colour photographic materials usually contain at least one red-sensitive, at least one green-sensitive and at least one blue-sensitive silver halide emulsion layer, and optionally contain intermediate layers and protective layers also.

Depending on the type of photographic material, these layers may be arranged differently. This will be illustrated for the most important products:

Colour photographic films such as colour negative films and colour reversal films comprise, in the following sequence on their support: 2 or 3 red-sensitive, cyan-coupling silver halide emulsion layers, 2 or 3 green-sensitive, magenta-coupling silver halide emulsion layers, and 2 or 3 blue-sensitive, yellow-coupling silver halide emulsion layers. The layers of identical spectral sensitivity differ as regards their photographic speed, wherein the less sensitive partial layers are generally disposed nearer the support than are the more highly sensitive partial layers.

A yellow filter layer is usually provided between the green-sensitive and blue-sensitive layers, to prevent blue light from reaching the layers underneath.

The options for different layer arrangements and their effects on photographic properties are described in J. Inf. Rec. Mats., 1994, Vol. 22, pages 183–193, and in Research Disclosure 38957, Part XI (1996), page 624.

As a preferred readout sensor, colour photographic paper, which as a rule is less sensitive to light than is colour photographic film, usually comprises the following layers on the support, in the following sequence: a blue-sensitive, yellow-coupling silver halide emulsion layer, a green-sensitive, magenta-coupling silver halide emulsion layer, and a red-sensitive, cyan-coupling silver halide emulsion layer; the yellow filter layer can be omitted.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE-25 30 645).

The essential constituents of the photographic emulsion layer are binders, silver halide grains and colour couplers.

Information on suitable binders is given in Research Disclosure 37254, Part 2 (1995), page 286, and in Research Disclosure 38957, Part II A (1996), page 598.

Information on suitable silver halide emulsions, their production, ripening, stabilisation and spectral sensitisation, including suitable spectral sensitisers, is given in Research Disclosure 37254, Part 3 (1995), page 286, in Research Disclosure 37038, Part XV (1995), page 89, and in Research Disclosure 38957, Part V.A (1996), page 603.

Photographic materials which exhibit camera-sensitivity usually contain silver bromide-iodide emulsions, which may also optionally contain small proportions of silver chloride. Photographic copier materials contain either silver chloride-bromide emulsions comprising up to 80 mole % AgBr, or silver chloride-bromide emulsions comprising more than 95 mole % AgCl.

Information on colour couplers is to be found in Research Disclosure 37254, Part 4 (1995), page 288, in Research Disclosure 37038, Part II (1995), page 80, and in Research Disclosure 38957, Part X.B (1996), page 616. The maximum absorption of the dyes formed from the couplers and from the colour developer oxidation product preferably falls within the following ranges: yellow couplers 430 to 460 mn, magenta couplers 540 to 560 mn, cyan couplers 630 to 700 nm.

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, in Research Disclosure 37038, Part XIV (1995), page 86, and in Research Disclosure 38957, Part X.C (1996), page 618.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, in Research Disclosure 37038, Part III (1995), page 84, and in Research Disclosure 38957, Part X.D (1996), page 621 et seq.

The photographic material may additionally contain compounds which absorb UV light, brighteners, spacers, filter dyes, formalin scavengers, light stabilisers, anti-oxidants, $D_{Min}$ dyes, plasticisers (latices), biocides, additives for improving the coupler—and white stability, to reduce colour fogging and to reduce yellowing, and other substances. Suitable compounds are given in Research Disclosure 37254, Part 8 (1995), page 292, in Research Disclosure 37038, Parts IV, V, VI, VII, X, XI and XIII (1995), pages 84 et seq., and in Research Disclosure 38957, Parts VI, VIII, IX, X (1996), pages 607, 610 et seq.

The layers of colour photographic materials are usually hardened, i.e. the binder used, preferably gelatine, is crosslinked by suitable chemical methods.

Suitable hardener substances are described in Research Disclosure 37254, Part 9 (1995), page 294, in Research Disclosure 37038, Part XII (1995), page 86, and in Research Disclosure 38957, Part II.B (1996), page 599.

After image-by-image exposure, colour photographic materials are processed by different methods corresponding to their character. Details on the procedures used and the chemicals required therefor are published in Research Disclosure 37254, Part 10 (1995), page 294, in Research Disclosure 37038, Parts XVI to XXIII (1995), page 95 et seq., and in Research Disclosure 38957, Parts XVIII, XIX, XX (1996), together with examples of materials.

The present invention further relates to the production of a colour photographic image by at least the steps comprising exposure, developing, bleaching, fixing and drying a material according to claim 1, wherein bleaching and fixing can also be combined as bleach-hardening, characterised in that developing is carried out using a p-phenylenediamine developer. p-phenylenediamine developers are known; CD-3 and CD-4 are preferred.

EXAMPLE 1

(comparison material B-1)

A colour photographic recording material for the colour development of colour negatives was produced (layer structure 1A) by depositing the following layers in the given sequence on a transparent film base made of cellulose triacetate. The quantitative data are given with respect to 1 $m^2$ in each case. The corresponding amounts of $AgNO_3$ are quoted for the deposition of silver halides; the silver halides were stabilised with 0.5 g 4-hydroxy-6-methyl-1,3,3 *a*,7-tetraazaindene per mol $AgNO_3$.

| 1st layer | (anti-halo layer) |
|---|---|
| 0.3 g | black colloidal silver |
| 1.2 g | gelatine |
| 0.3 g | UV absorber UV-1 |
| 0.2 g | DOP (developer oxidation product) - scavenger SC-1 |
| 0.02 g | tricresyl phosphate (TCP) |

| 2nd layer | (low red-sensitivity layer) |
|---|---|
| 0.7 g | $AgNO_3$ of an AgBrI emulsion which was spectrally sensitised to red, 4 mol % iodide, average grain diameter 0.42 $\mu$m |
| 1 g | gelatine |
| 0.35 g | colourless coupler C-1 |
| 0.05 g | coloured coupler RC-1 |
| 0.03 g | coloured coupler YC-1 |
| 0.36 g | TCP |

| 3rd layer | (medium red-sensitivity layer) |
|---|---|
| 0.8 g | $AgNO_3$ of an AgBrI emulsion which was spectrally sensitised to red, 5 mol % iodide, average grain diameter 0.53 $\mu$m |
| 0.6 g | gelatine |
| 0.15 g | colourless coupler C-2 |
| 0.03 g | coloured coupler RC-1 |
| 0.02 g | DIR-coupler D-1 |
| 0.18 g | TCP |

| 4th layer | (high red-sensitivity layer) |
|---|---|
| 1 g | $AgNO_3$ of an AgBrI emulsion which was spectrally sensitised to red, 6 mol % iodide, average grain diameter 0.85 $\mu$m |
| 1 g | gelatine |
| 0.1 g | colourless coupler C-2 |
| 0.005 g | DIR-coupler D-2 |
| 0.11 g | TCP |

| 5th layer | (intermediate layer) |
|---|---|
| 0.8 g | gelatine |
| 0.07 g | DOP scavenger SC-2 |
| 0.06 g | aluminium salt of aurinetricarboxylic acid |

| 6th layer | (low green-sensitivity layer) |
|---|---|
| 0.5 g | $AgNO_3$ of an AgBrI emulsion which was spectrally sensitised to green, 4 mol % iodide, average grain diameter 0.35 $\mu$m |
| 0.8 g | gelatine |
| 0.22 g | colourless coupler M-1 |

-continued

| 6th layer | (low green-sensitivity layer) |
|---|---|
| 0.3 g | coloured coupler YM-1 |
| 0.02 g | DIR coupler D-6 |
| 0.52 g | TCP |

| 7th layer | (medium green-sensitivity layer) |
|---|---|
| 1.5 g | $AgNO_3$ of an AgBrI emulsion which was spectrally sensitised to green, 4 mol % iodide, average grain diameter 0.50 μm |
| 1 g | gelatine |
| 0.16 g | colourless coupler M-1 |
| 0.2 g | coloured coupler YM-1 |
| 0.015 g | DIR coupler D-5 |
| 0.36 g | TCP |

| 8th layer | (high green-sensitivity layer) |
|---|---|
| 2,0 g | $AgNO_3$ of an AgBrI emulsion which was spectrally sensitised to green, 6 mol % iodide, average grain diameter 0.70 μm |
| 1.1 g | gelatine |
| 0.05 g | colourless coupler M-2 |
| 0.05 g | coloured coupler YM-2 |
| 0.005 g | DIR coupler D-4 |
| 0.1 g | TCP |

| 9th layer | (yellow filter layer) |
|---|---|
| 0.09 g | yellow dye GF-1 |
| 1 g | gelatine |
| 0.08 g | DOP scavenger SC-2 |
| 0.26 g | TCP |

| 10th layer | (low blue-sensitivity layer) |
|---|---|
| 0.3 g | $AgNO_3$ of an AgBrI emulsion which was spectrally sensitised to blue, 6 mol % iodide, average grain diameter 0.44 μm |
| 0.5 g | $AgNO_3$ of an AgBrI emulsion which was spectrally sensitised to blue, 6 mol % iodide, average grain diameter 0.50 μm |
| 1.9 g | gelatine |
| 1.1 g | colourless coupler Y-1 |
| 0.037 g | DIR coupler D-6 |
| 0.6 g | TCP |

| 11th layer | (high blue-sensitivity layer) |
|---|---|
| 0.6 g | $AgNO_3$ of an AgBrI emulsion which was spectrally sensitised to blue, 7 mol % iodide, average grain diameter 0.95 μm |
| 1.2 g | gelatine |
| 0.1 g | colourless coupler Y-1 |
| 0.006 g | DIR coupler D-3 |
| 0.11 g | TCP |

| 12th layer | (micrate layer) |
|---|---|
| 0.1 g | $AgNO_3$ of a micrate-AgBrI emulsion, 0.5 mol % iodide, average grain diameter 0.06 μm |
| 1 g | gelatine |
| 0.004 mg | $K_2[PdCl_4]$ |
| 0.4 g | UV absorber UV-2 |
| 0.3 g | TCP |

| 13th layer | (protective and hardening layer) |
|---|---|
| 0.25 g | gelatine |
| 0.75 g | hardener H-1 |

After hardening, the overall layer structure had a swelling factor ≦3.5.

Substances used in Example 1:

UV-1

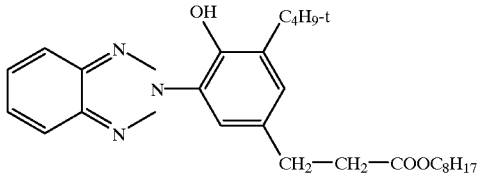

UV-2

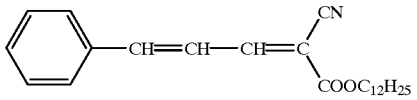

C-1

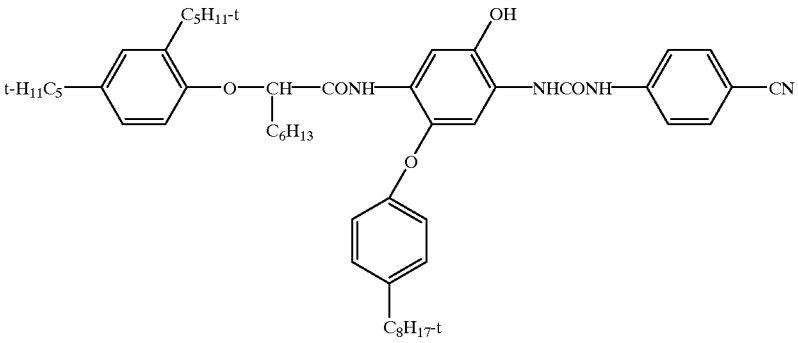

-continued
C-2
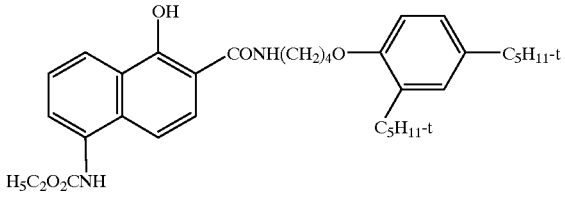
RC-1
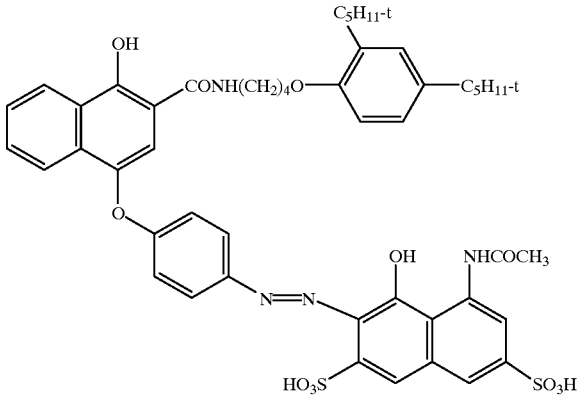
YC-1
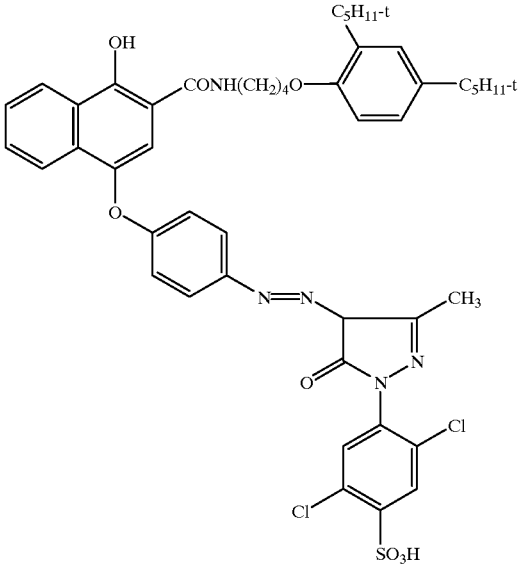
M-1
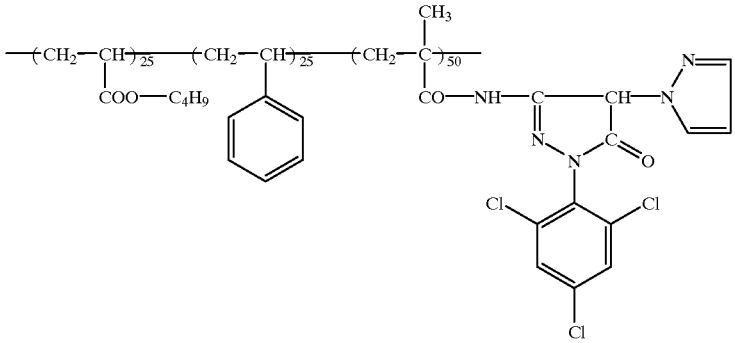

-continued
M-2
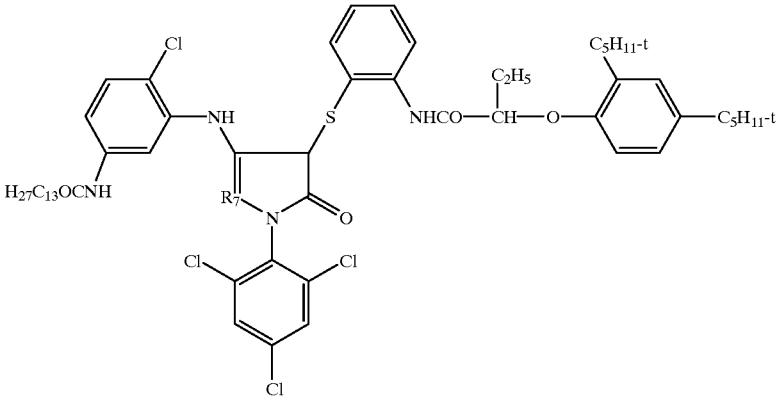
YM-1
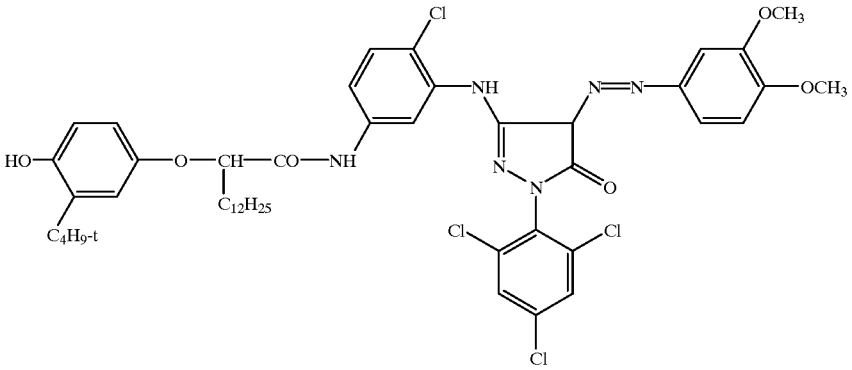
YM-2
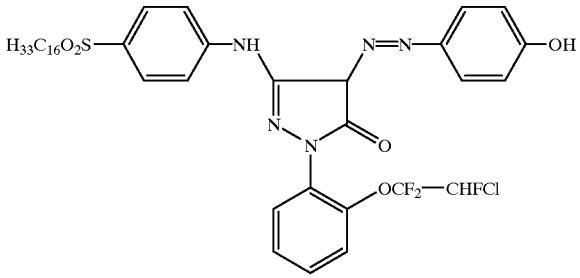
Y-1
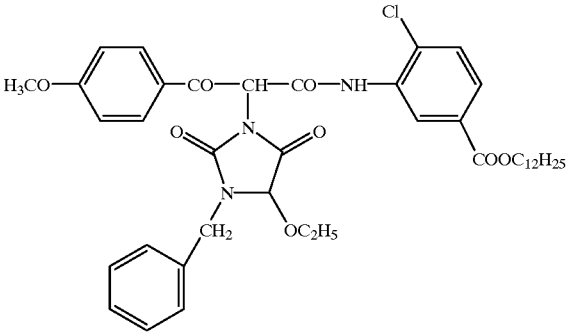
D-1
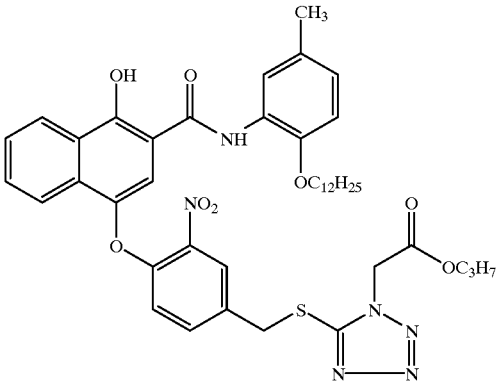
D-2
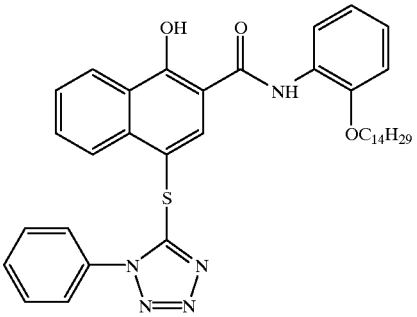

-continued

D-3

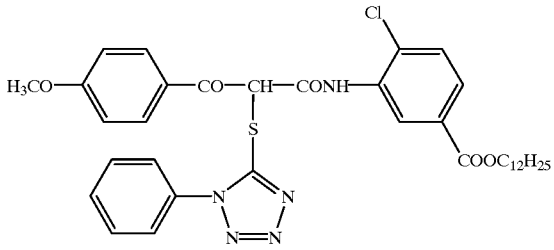

D-4

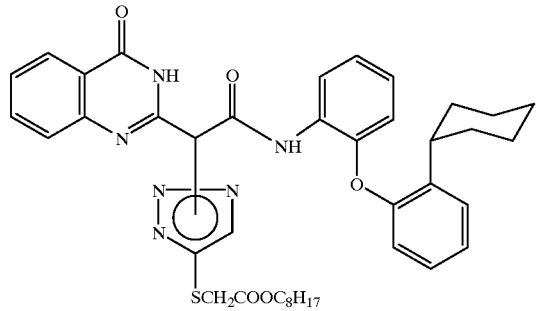

D-5

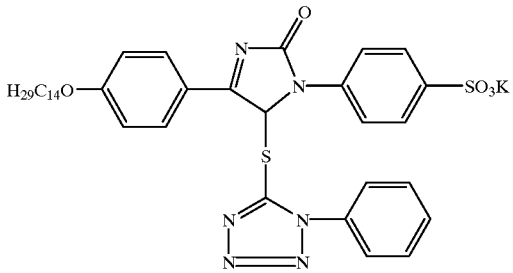

D-6

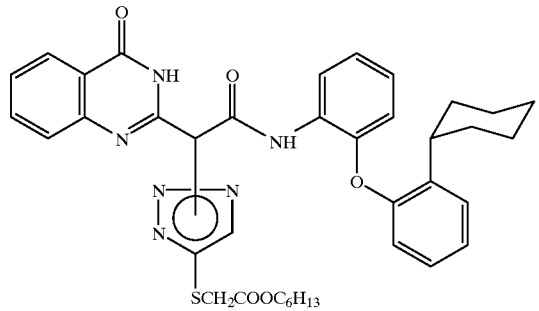

SC-1

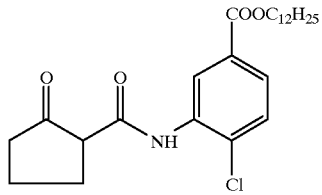

SC-2

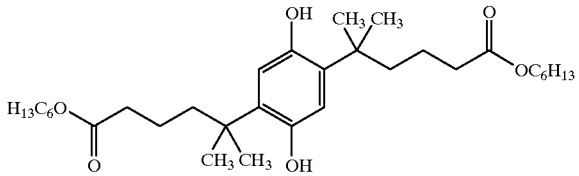

GF-1

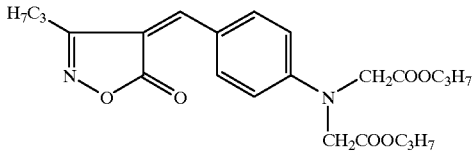

H-1

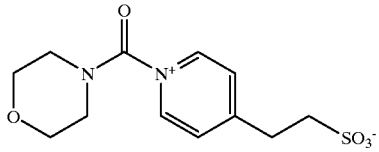

After exposure through a neutral wedge filter, development was carried out as described in "The British Journal of Photography", 1974, pages 597 and 598.

Table 1 shows the changes in the green-sensitive layers of Examples 1B to 1D compared with Example 1A and the results obtained. 1C. and 1D are according to the invention.

TABLE 1

| | AgX deposition in $AgNO_3$ equivalents | | | Coupler deposition | | | DIR coupler deposition | | |
|---|---|---|---|---|---|---|---|---|---|
| | | | | M-2 | | | D-4 | D-5 | D-6 |
| Ex. | high-sensy. layer | medium-sensy. layer | low-sensy. layer | high-sensy. layer | M-1 medium-sensy. layer | M-1 low- sensy. layer | high-sensy. layer | medium-sensy. layer | low-sensy. layer |
| 1A | 2 g/m$^2$ | 1.5 g/m$^2$ | 0.5 g/m$^2$ | 50 mg/m$^2$ | 200 mg/m$^2$ | 300 mg/m$^2$ | 5 mg/m$^2$ | 15 mg/m$^2$ | 5 mg/m$^2$ |
| 1B | 1.5 g/m$^2$ | 1 g/m$^2$ | 0.5 g/m$^2$ | 30 mg/m$^2$ | 125 mg/m$^2$ | 200 mg/m$^2$ | — | 5 mg/m$^2$ | — |
| 1C | 1.5 g/m$^2$ | 1 g/m$^2$ | 0.5 g/m$^2$ | 25 mg/m$^2$ | 100 mg/m$^2$ | 155 mg/m$^2$ | — | 5 mg/m$^2$ | — |
| 1D | 2 g/m$^2$ | 1.5 g/m$^2$ | 0.5 g/m$^2$ | 45 mg/m$^2$ | 175 mg/m$^2$ | 255 mg/m$^2$ | 5 mg/m$^2$ | 15 mg/m$^2$ | 5 mg/m$^2$ |

TABLE 1-continued

| | cyan->magenta masking deposition | | | | | |
|---|---|---|---|---|---|---|
| | MK-1 high-sensy. | MK-1 medium-sensy. | MK-1 low-sensy. | Results | | |
| Ex. | layer | layer | layer | E | Gradation | IIE |
| 1A | — | — | — | 3.65 | 0.65 | 140% |
| 1B | — | — | — | 3.66 | 0.64 | 110% |
| 1C | 10 mg/m$^2$ | 50 mg/m$^2$ | 90 mg/m$^2$ | 3.66 | 0.66 | 145% |
| 1D | 10 mg/m$^2$ | 50 mg/m$^2$ | 90 mg/m$^2$ | 3.64 | 0.64 | 165% |

1C exhibits the same inter-image effects as 1A at a considerably reduced deposition of silver. At the same deposition of silver (1B), 1C exhibits a considerably higher inter-image effect. 1D exhibits a considerably increased inter-imaging effect compared with 1A, due to the addition of the masking coupler according to the invention at the same deposition of silver as in 1A.
E = sensitivity
IIE = inter-image effect

What is claimed is:

1. A color photographic silver halide material which comprises a support which comprises at least one blue-sensitive, yellow-coupling silver halide emulsion layer and at least one green-sensitive, magenta-coupling silver halide emulsion layer, and which comprises at least one red-sensitive, cyan-coupling silver halide emulsion layer which is further from the light source than are the at least one blue-sensitive layer and the at least one green-sensitive, magenta-coupling silver halide emulsion layer, and the material contains at least one cyan masking coupler which has its maximum absorption above 650 nm, the red-sensitive layers have a maximum sensitivity at 620±20 nm and the absorption of the masking coupler at the maximum sensitivity of the red-sensitive layers is at most 70% of its absorption at 690 nm, wherein the blue- and green-sensitive layers are deposited on one side of the support and the red-sensitive layers are deposited on the other side of the support.

2. The color photographic silver halide material according to claim 1, wherein the silver halide material is a color negative film.

3. The color photographic silver halide material according to claim 1, wherein the masking coupler is used in a green-sensitive layer.

4. The color photographic silver halide material according to claim 1, wherein the masking coupler is used in a blue-sensitive layer.

5. A process for producing a photographic image by at least the steps comprising exposing, developing, bleaching, fixing and drying a material according to claim 1, wherein bleaching and fixing can also be combined as bleach-hardening, and developing is carried out using a p-phenylenediamine developer.

6. A color photographic silver halide material which comprises a support which comprises at least one blue-sensitive, yellow-coupling silver halide emulsion layer and at least one green-sensitive, magenta-coupling silver halide emulsion layer, and which comprises at least one red-sensitive, cyan-coupling silver halide emulsion layer which is further from the light source than are the at least one blue-sensitive layer and the at least one green-sensitive, magenta-coupling silver halide emulsion layer, and the material contains at least one cyan masking coupler which has its maximum absorption above 650 nm, the red sensitive layers have a maximum sensitivity at 620±20 nm and the absorption of the masking coupler at the maximum sensitivity of the red-sensitive layers is at most 70% of its absorption at 690 nm, wherein the masking coupler corresponds to formula (I)

Kup-Link-Farb (I)

wherein

Kup-Link corresponds to one of formulae (II), (III), or (IV)

(II)

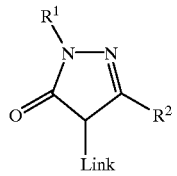

(III)

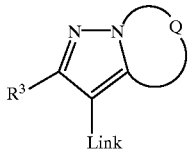

(IV)

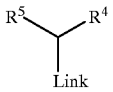

wherein $R^1$ denotes an unsubstituted phenyl or a phenyl which is singly- or multiply-substituted by a halogen, alkyl, cyano, alkoxy, alkoxycarbonyl or acylamino, $R^2$ denotes alkylamino, arylamino, acylamino or carbamoylamino, $R^3$ denotes a hydrogen atom or a substituent, $R^4$ and $R^5$ independently denote electron acceptor groups, Q denotes the non-metallic atoms for the completion of a 5-membered azole ring which contains 2 to 4 nitrogen atoms and which are optionally substituted and Farb denotes the residue of a cyan dye.

7. The color photographic silver halide material according to claim 6, wherein $R^4$ and $R^5$ are independently acyl, alkoxycarbonyl, aryloxycarbonyl, carbamoyl, cyano, nitro, sulphamoyl, alkylsulphonyl, arylsulphonyl, aryl, or heterocyclic groups which can be joined together to form a ring.

8. The color photographic silver halide material according to claim 6, wherein $R^1$ is 2, 4, 6-trichlorophenyl; 2, 5-dichlorophenyl or 2-chlorophenyl, $R^2$ is arylamino or acylamino, $R^3$ is $CONHR^{41}$, wherein $R^{41}$ is a substituted phenyl and $R^5$ is $COR^{51}$, wherein $R^{51}$ is tert-butyl, 4-methoxyphenyl or 1-ethylcyclopropyl.

9. The color photographic silver halide material according to claim 6, wherein the silver halide material is a color negative film.

10. The color photographic silver halide material according to claim 6, wherein the masking coupler is used in a green-sensitive layer.

11. The color photographic silver halide material according to claim 6, wherein the masking coupler is used in a blue-sensitive layer.

12. The color photographic silver halide material according to claim 6, wherein Link is a single chemical bond, or is a bridging group which is bonded to the coupling position of Kup via a sulphur, nitrogen or oxygen and which optionally contains one or more time control groups.

13. A process for producing a photographic image by at least the steps comprising exposing, developing, bleaching, fixing and drying a material according to claim 6, wherein bleaching and fixing can also be combined as bleach-hardening, and developing is carried out using a p-phenylenediamine developer.

14. A color photographic silver halide material which comprises a support which comprises at least one blue-sensitive, yellow-coupling silver halide emulsion layer and at least one green-sensitive, magenta-coupling silver halide emulsion layer, and which comprises at least one red-sensitive, cyan-coupling silver halide emulsion layer which is further from the light source than are the at least one blue-sensitive layer and the at least one green-sensitive, magenta-coupling silver halide emulsion layer, and the material contains at least one cyan masking coupler which has its maximum absorption above 650 nm, the red-sensitive layers have a maximum sensitivity at 620±20 nm and the absorption of the masking coupler at the maximum sensitivity of the red-sensitive layers is at most 70% of its absorption at 690 nm, wherein the masking coupler corresponds to formula (I)

Kup-Link-Farb (I)

wherein

Kup denotes the residue of a color coupler,

Link denotes a linking group, and

Farb denotes the residue of a cyan dye and wherein Farb is a chromophore, the extinction coefficient of which at 690 nm is at least 30% higher than it is at 620 nm and which is an azomethine dye comprising a coupler residue chosen from formulas (V) to (X) and a phenylenediamine developer component of formula (XI):

(V)

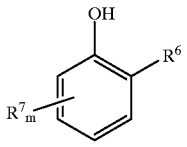

-continued (VI)

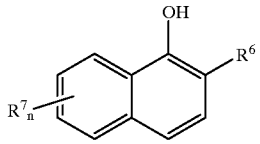

(VII)

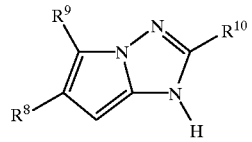

(VIII)

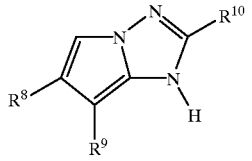

(IX)

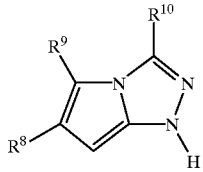

(X)

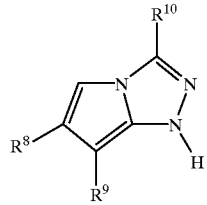

wherein $R^6$ denotes H, $SO_2NR^{61}R^{62}$, $SO_3R^{61}$, $CO_2R^{61}$, $CONR^{61}R^{62}$, $NHCOR^{62}$, $NHCONR^{61}R^{62}$, $NHSO_2R^{61}R^{62}$, $NHSO_2R^{61}$ or hetaryl $R^7$ denotes a substituent, $R^8$, $R^9$, $R^{10}$, $R^{61}$ and $R^{62}$, independently of each other, denote H or a substituent, and $R^8$ and $R^9$ or $R^{61}$ and $R^{62}$ are optionally linked to form a ring, m denotes 0–2, n denotes 0–4, (XI)

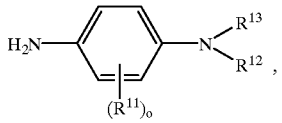

wherein $R^{11}$ denotes a substituent, $R^{12}$ and $R^{13}$ independently of one another denote alkyl, aryl or hetaryl, or $R^{11}$ and $R^{12}$ together or $R^{12}$ and $R^{13}$ together denote the remaining members of a ring, o denotes a number from 0 to 4, and Farb is linked to Link by one of the substituents $R^6$ to $R^{13}$, and one of the $R^6$ to $R^{13}$ radicals, or the Link radical provided that it remains linked to Farb after chromogenic processing, contains at least one group which imparts water-solubility.

15. The color photographic silver halide material according to claim 14, wherein $R^{11}$ and $R^{12}$ together or $R^{12}$ and $R^{13}$ together form a 5- or 6-membered ring.

16. The color photographic silver halide material according to claim 14, wherein Farb after chromogenic processing, contains at least one group which imparts water-solubility and is selected from the group consisting of a sulphonic acid, a sulphonamide, a carboxylic acid, a carbonamide, a hydroxy group, a polyether, an amino group and an acid group which contains phosphorus.

17. The color photographic silver halide material according to claim 14, wherein the silver halide material is a color negative film.

18. The color photographic silver halide material according to claim 14, wherein the masking coupler is used in a green-sensitive layer.

19. The color photographic silver halide material according to claim 14, wherein the masking coupler is used in a blue-sensitive layer.

20. A process for producing a photographic image by at least the steps comprising exposing, developing, bleaching, fixing and drying a material according to claim 14, wherein bleaching and fixing can also be combined as bleach-hardening, and developing is carried out using a p-phenylenediamine developer.

* * * * *